United States Patent [19]

Hoyt et al.

[11] Patent Number: 5,054,219

[45] Date of Patent: Oct. 8, 1991

[54] REVOLVING SIGN AND RELATED DRIVE

[76] Inventors: Wilber S. Hoyt, 406 Beverly Dr., Lafayette, La. 70503; James G. Close, 16 Big Oak Cir., S.H. Malakoff, Tex. 75148

[21] Appl. No.: 503,043

[22] Filed: Apr. 2, 1990

[51] Int. Cl.[5] ..... G09F 11/02

[52] U.S. Cl. ..... 40/473; 40/607

[58] Field of Search ..... 40/473, 474, 431–435, 40/470, 493, 584, 591, 607, 430, 606; 272/31 P; 446/236, 237, 238; 248/292, 218.4–219.4, 225.31, 250, 122, 296

[56] References Cited

U.S. PATENT DOCUMENTS

| | | | |
|---|---|---|---|
| 979,605 | 12/1910 | Turnpaugh | 40/473 |
| 1,045,642 | 11/1912 | Torrey | 40/473 |
| 1,513,521 | 10/1924 | Robertson | 40/473 |
| 2,100,853 | 11/1937 | Jennings | 40/473 |
| 2,625,762 | 1/1953 | McColl | 40/607 |
| 2,913,954 | 11/1959 | Morgan | 40/431 |

FOREIGN PATENT DOCUMENTS

| | | | |
|---|---|---|---|
| 25036 | 10/1935 | Austria | 40/473 |
| 213040 | 8/1956 | Austria | 40/493 |
| 2608819 | 6/1988 | France | 40/607 |

*Primary Examiner*—Kenneth J. Dorner
*Assistant Examiner*—James M. Gardner
*Attorney, Agent, or Firm*—Pravel, Gambrell, Hewitt, Kimball & Krieger

[57] ABSTRACT

A motor driven multi-faced revolving sign for mounting on existing sign pedestals. Whereby a removable quarter section is provided so that the sign may be clamp mounted around an existing sign pedestal without removing the existing sign. An adaptor is also provided to facilitate the mounting and operation of the sign regardless of size or configuration of most existing pedestals.

20 Claims, 8 Drawing Sheets

REVOLVING SIGN AND RELATED DRIVE

BACKGROUND OF THE INVENTION

1. Field Of The Invention

The apparatus of the present invention relates to outdoor signs. More particularly, the present invention relates to rotating signs, and the adaptability of such signs to a variety of existing sign support columns, regardless of their size or shape.

2. General Background

Lighted signs in recent years must compete with many others of the same type. Therefore, signs are being placed higher, made larger, and rotatable to attract attention. Because of the inaccessibility of these signs, a need has developed for a rotating multi-faced sign that can be installed around an existing sign pedestal support, whereby the face panels can be easily and economically changed on a frequent basis.

Traditionally commercial pedestal supported rotary signs are constructed with two or more faces forming a hollow shell. Such signs are usually driven by motors contained within the confines of the sign. Rotating signs of this type are mounted on pedestal columns that place the sign in a position to attract attention from as far away as possible. In most cases the signs are back lighted.

Signs located well off the ground, and requiring a power source for driving or illumination, provide the ideal location for a second sign located midway between the ground and the existing sign.

Various means of commutation have been developed for rotating signs. Most commutation practices involve the use of commutator rings attached to the pedestal support while the motor, gear reduction and lighting systems are allowed to rotate with the sign. Bearings and belt pulleys are usually fixed to the pedestal support providing a stationery element for the drive means. Drive protection during high wind loads is usually achieved by allowing the drive belt to slip. Construction and maintenance of such signs necessitates providing a support pedestal and its interrelated commutation means. Since the support pedestal and the drive means are provided as a unit installation and service is usually performed by removing the top or bottom of the sign. Signs of this nature, because of their height and rigid construction invariably have face panels that are expensively formed and are not readily changeable.

SUMMARY OF THE PRESENT INVENTION

The present invention overcomes some of the disadvantages of the prior art and takes advantage of existing sign support columns regardless of their size or shape.

The present invention takes advantage of existing single column sign pedestals by utilizing such supports for mounting a rotatable multi-faced sign. The present invention provides a means for clamping a driving means around an existing sign support column or post, accommodating, with the use of adapters for a variety of column sizes or shapes. The drive means also serves as support for the multifaced rotatable sign around the support column. Access to the drive is gained by way of the easily removable face panels. The drive means comprises a friction wheel typel, designed to provide slip during high wind loads and eliminates the need for commutator rings. There is further provided a removable quarter section that allows the sign to be partially erected on the ground before being positioned around the support column. Special snap in corner moldings allow for quick removal of the advertising sheets.

Therefore, it is the principal object of the present invention to provide a rotating sign which may be adaptable to an existing sign support column or post, utilizing adapters for a variety of column sizes or shapes;

It is a further object of the present invention to provide a rotating sign whereby removable and replacement of the sign's advertising insert sheets, and sign illumination means can be achieved with minimum effort and without disturbing the integrity of the sign; and It is still a further object of the present invention to provide a rotating sign utilizing corrugated plastic face panels as backing for the advertising sheets, which results in a drastic reduction in weight, while still maintaining rigidity of the sign face.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
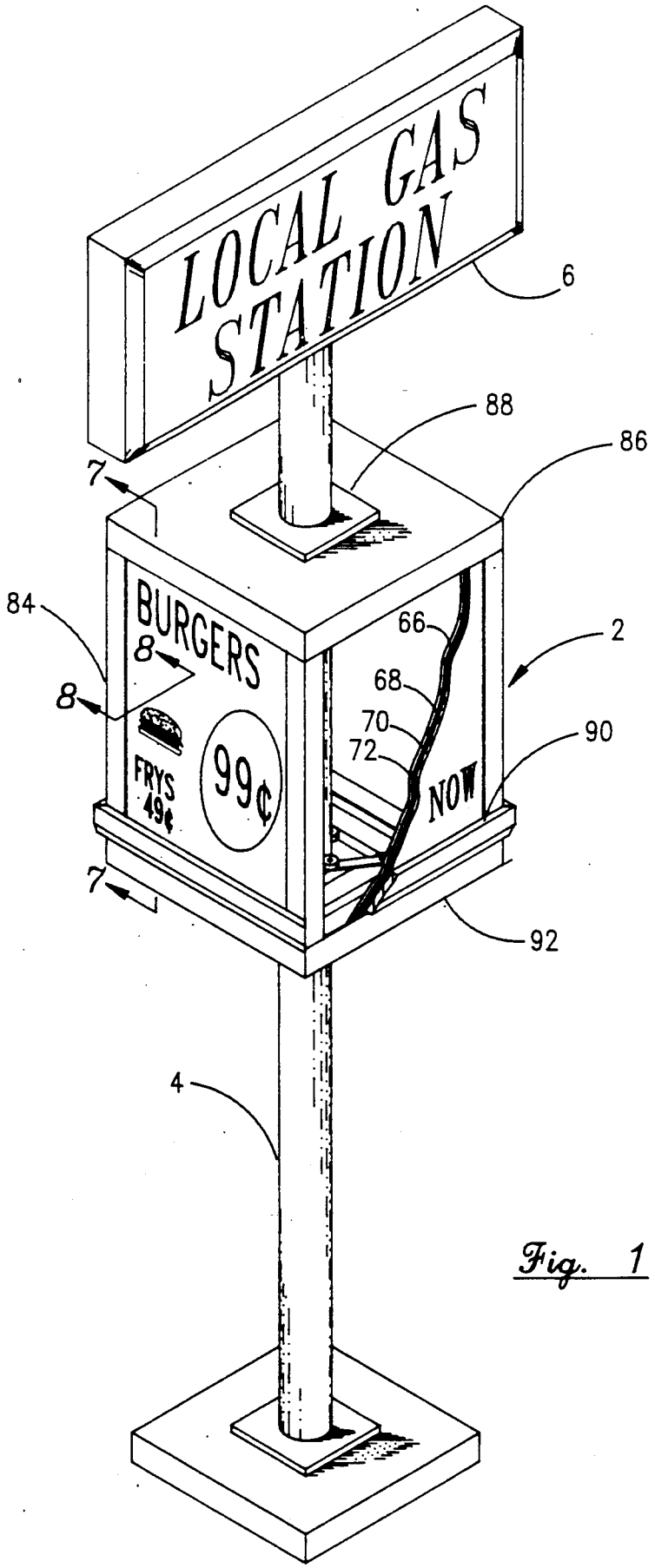
FIG. 1 illustrates the preferred embodiment of the present invention in partial cut-away view installed on an existing sign post.

As shown in FIG. 1, the present invention, a rotating multifaced sign 2, is mounted on an existing sign pedestal or post 4. The rotary sign 2 is mounted in close proximity and below the existing sign 6 utilizing the existing sign's power supply or providing a parallel circuit.

Figure 2:
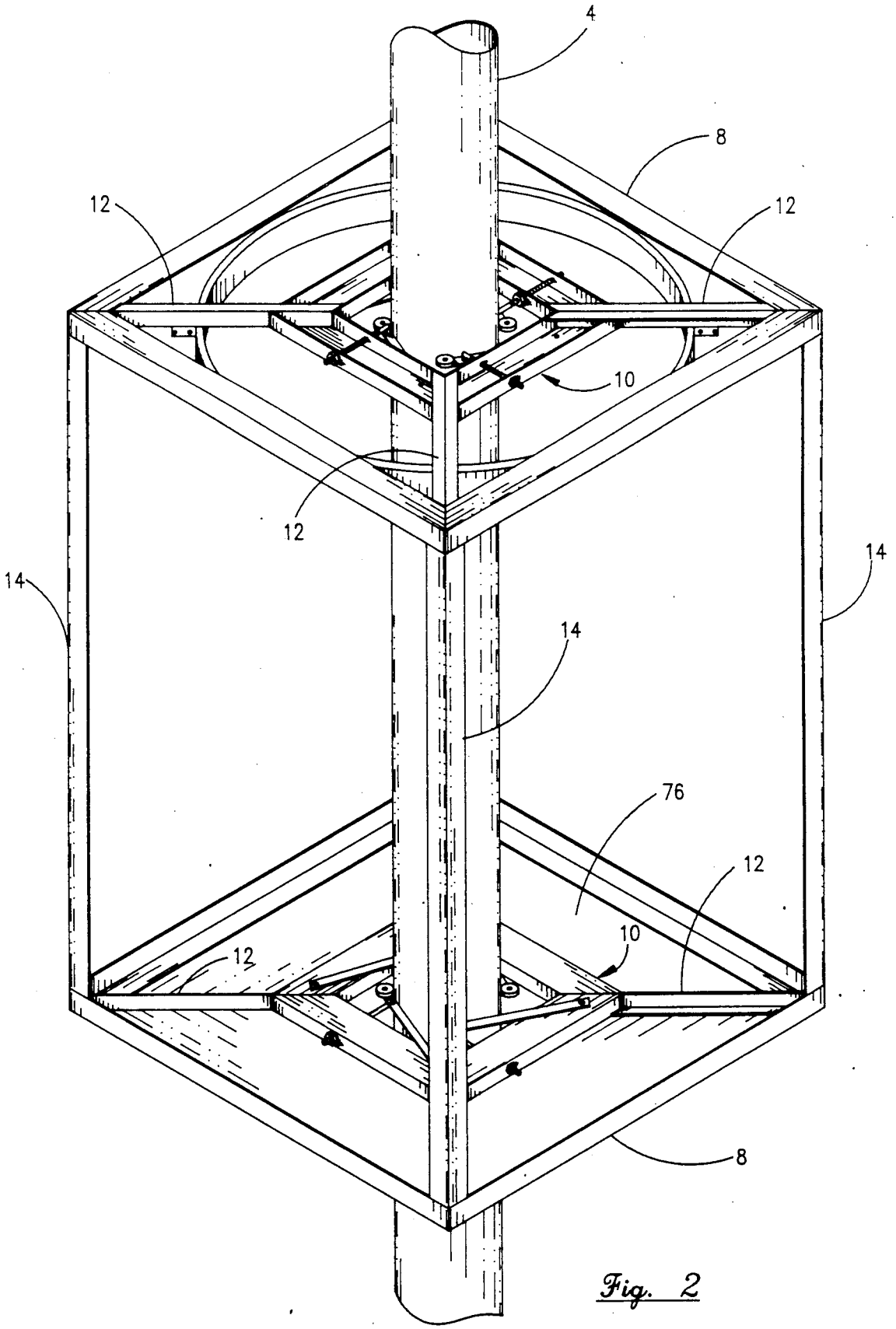
FIG. 2 is an isometric view of the rotating sign's skeletal structure, and the rotatable stabilizing elements and their relationship to the sign post.
Figure 3:
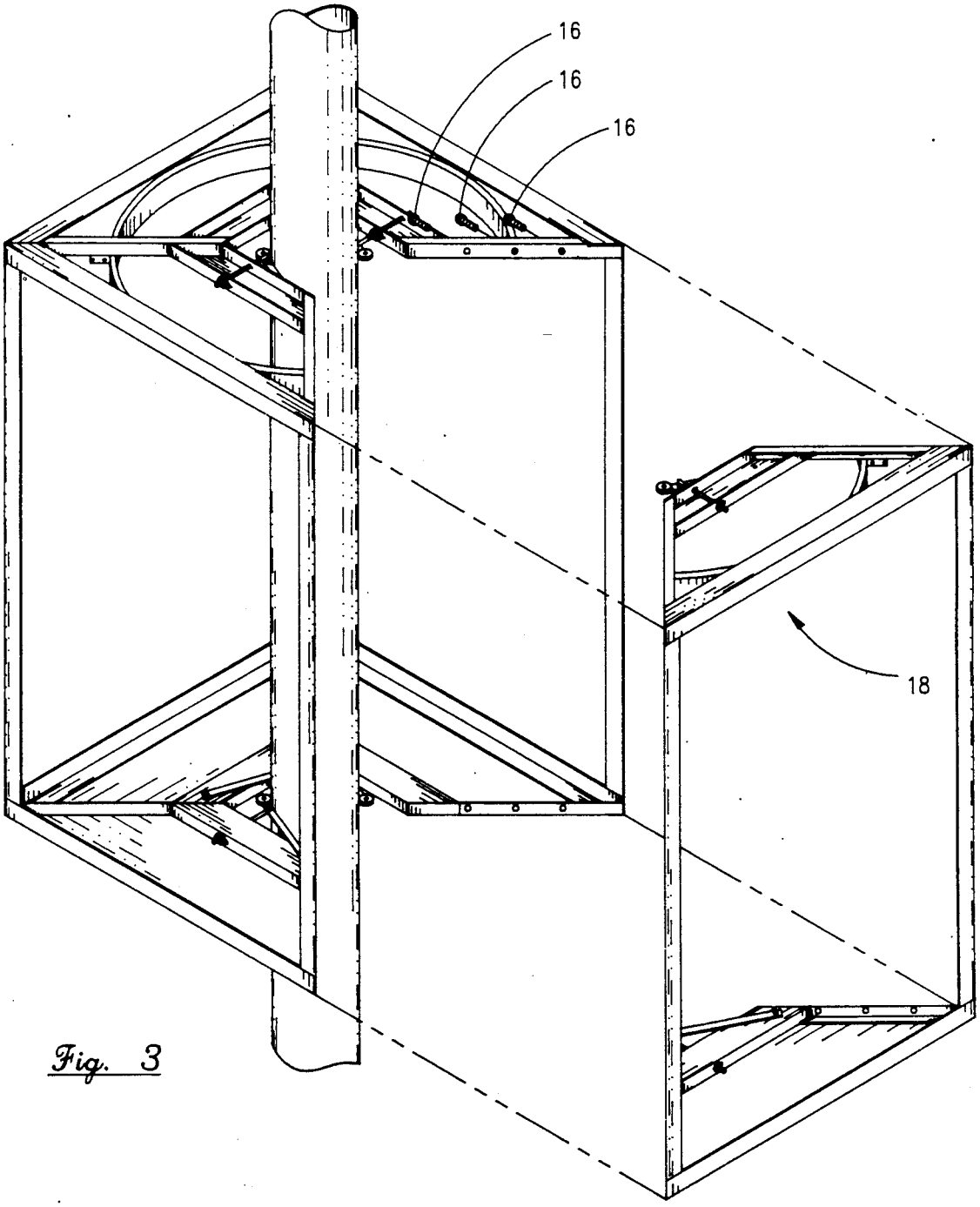
FIG. 3 is an isometric view of the skeletal structure of the rotating sign showing a removable quarter section.
Figure 9:
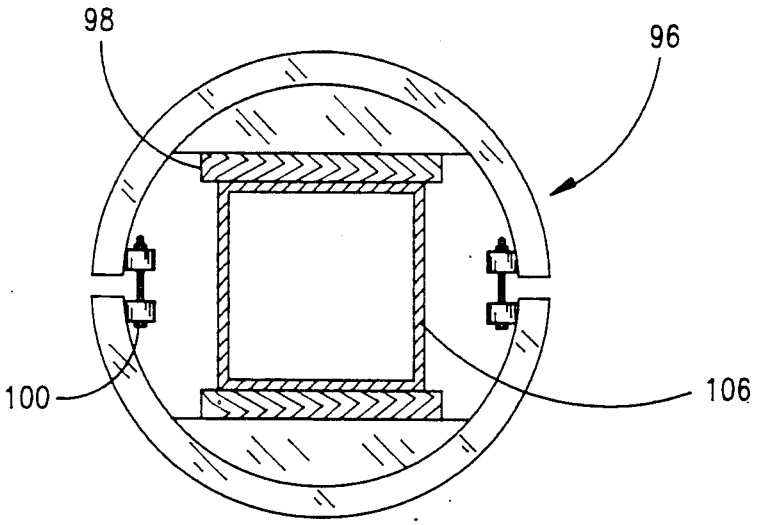
FIG. 9 is a plane view of the adapter collar and spacer blocks.

Turning now to FIG. 2, there is illustrated the structure frame work of the sign, comprising an upper and lower structural angle frame 8 each having an annular flange 10 supported by diagonal struts 12 attached to each of the frame's corners. The annular flanges 10 are constructed of structural channels with their external webs toward the inside of the sign 2. The upper and lower structural angle frames 8 are held in spaced apart relation by vertical structural angles 14 at each of the corners. The frames 8 are further constructed so as to allow at least one quarter section 18 to be held in place by fasteners 16, and can thereby be removed to allow for installment around an existing post or sign pedestal 4 as shown in FIG. 3. The annular flanges 10 also comprise adjustable stabilizing elements consisting of a pivotal arm 20 mounted pivotally on the face of each of the structural channel's external web. Each pivot arm 20 is fitted with a rotatable roller 22. The pivot arms are adjustable so as to hold the annular flanges in concentric alinement with the post or pedestal regardless of size or configuration. An adaptor collar as essentially shown in FIG. 9 is used to convert from square of odd shaped pedestals to the round shape required by rotatable roller 22.

Figure 6:
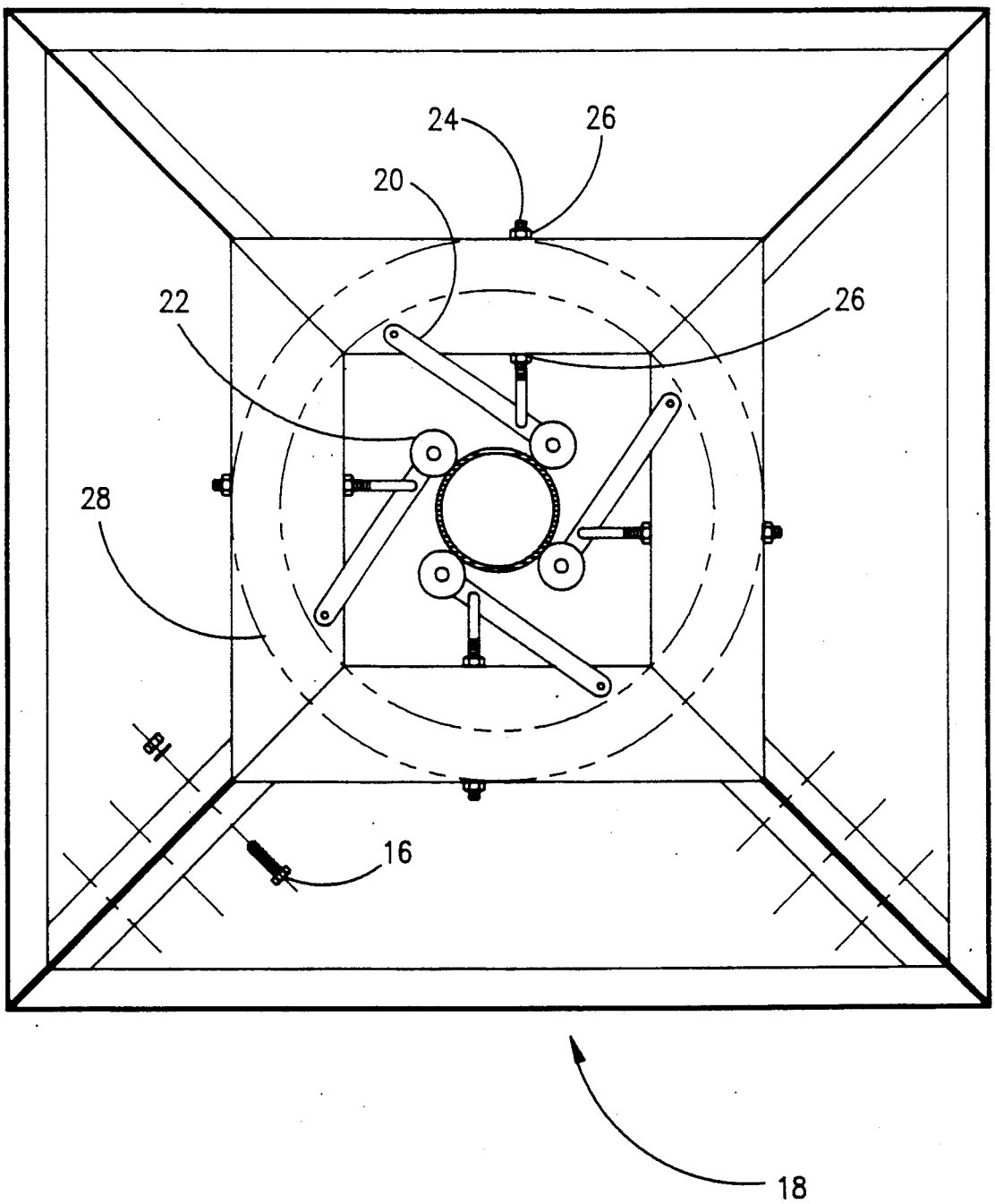
FIG. 6 is a section plan view as viewed in the direction shown along plane 6—6 in FIG. 4, illustrating the upper annular flange and support caster wheel path.

Adjustment, as seen in FIG. 6, is accomplished by the use of an all thread rod 24 pivotally mounted to the pivot arm 20 passing through holes in the annular channel 10 flanges and held in place by adjustment nuts 26 on either side of annular channel 10.

The upper annular flange 10 as shown in FIG. 6 also shows the support caster wheel path 28 along the face of the channels.

Figure 4:
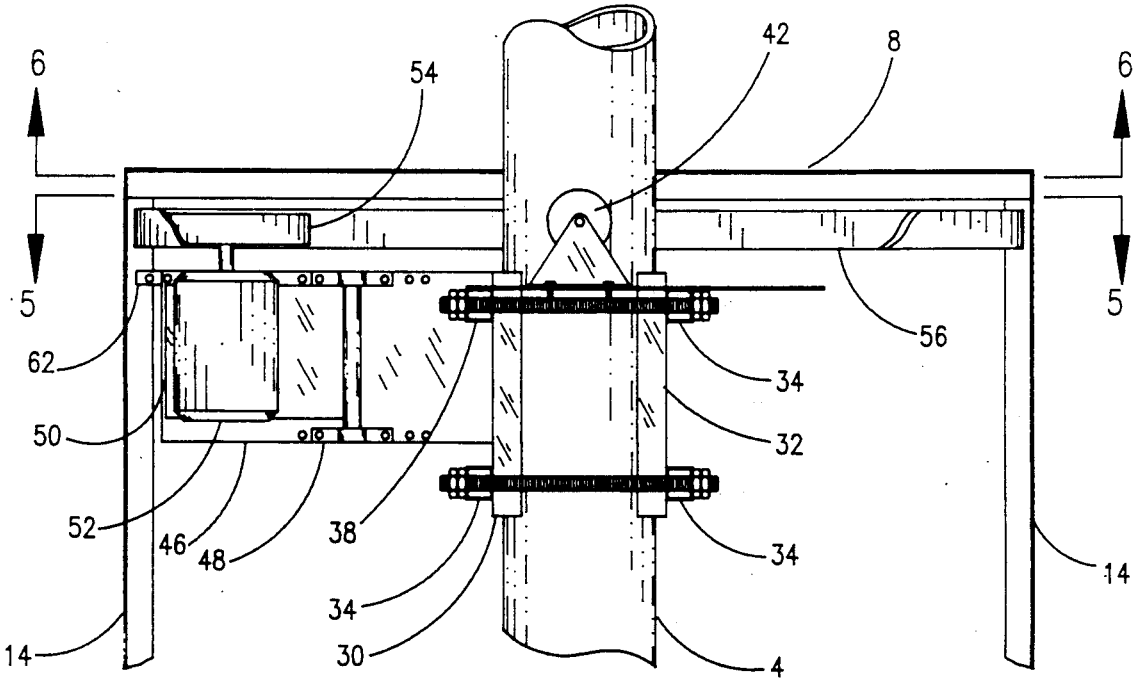
FIG. 4 is a partial side elevation view illustrating the sign support casters, and adjustable post clamping means and motor drive means.
Figure 5:
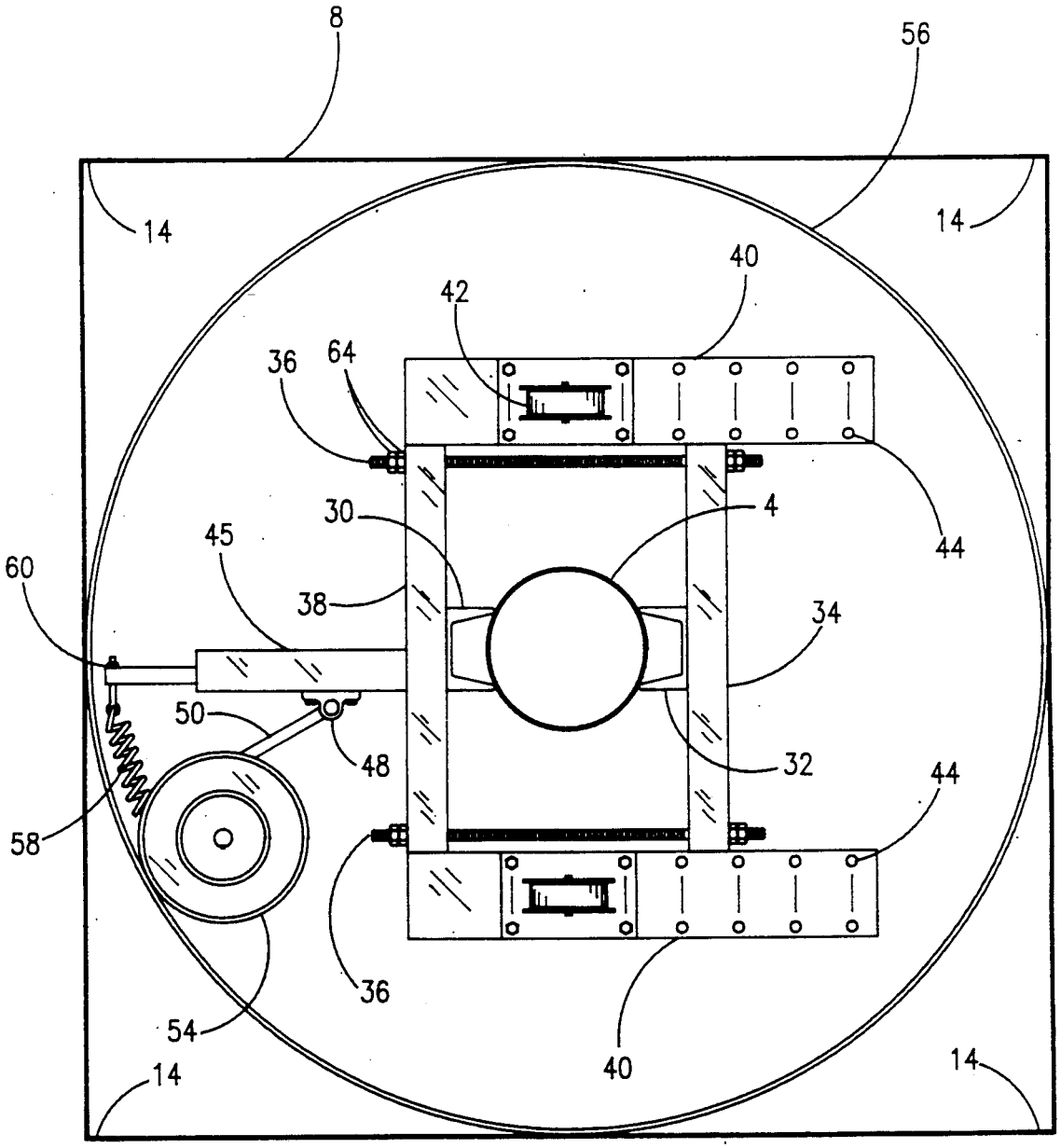
FIG. 5 is a section plan view as viewed in the direction shown along plane 5—5 in FIG. 4, illustrating the clamping arrangement around the sign post and the friction wheel and ring assemble.

The support clamp and drive arrangement as best seen in FIGS. 4 and 5 comprises a pair or structural channels with one positioned on either side of the post or pedestal 4. Channels 30 and 32 have a pair of tubular cross members 34 weldable attached to their external web face. Cross members 34 and 38 have perpendicular holes drilled horizontally near their distal ends to accept the clamp rods 36. Cross member 38 also has horizontal caster mounting plates 40 weldable mounted at each end and perpendicular to channel 30. Support casters 42 are fastener mounted vertically on mounting plates 40 and are repositionable with alternate holes 44 in order to maintain casters 42 on the center line of post 4 regardless of the post's diameter. Motor bracket plate 46 is weldable mounted perpendicular to the face of channel 30 and is provided with multiple mounting holes for positioning the two fastener mounted, motor pivot plate bearings 48. Friction wheel 54 mounted to electric motor 52 which is fastener mounted to motor pivot plate 50 is maintained in pivotal traction against friction ring 56 by applied tension maintained by biasing means 58 through adjuster eye bolt 60 mounted to tension arm 62. Clamping channels 30 and 32 are maintain in clamping arrangement by the four tie bolts 36 passing through cross members 34 and 38 and secured by adjuster nuts and jam nuts 64.

Figure 7:
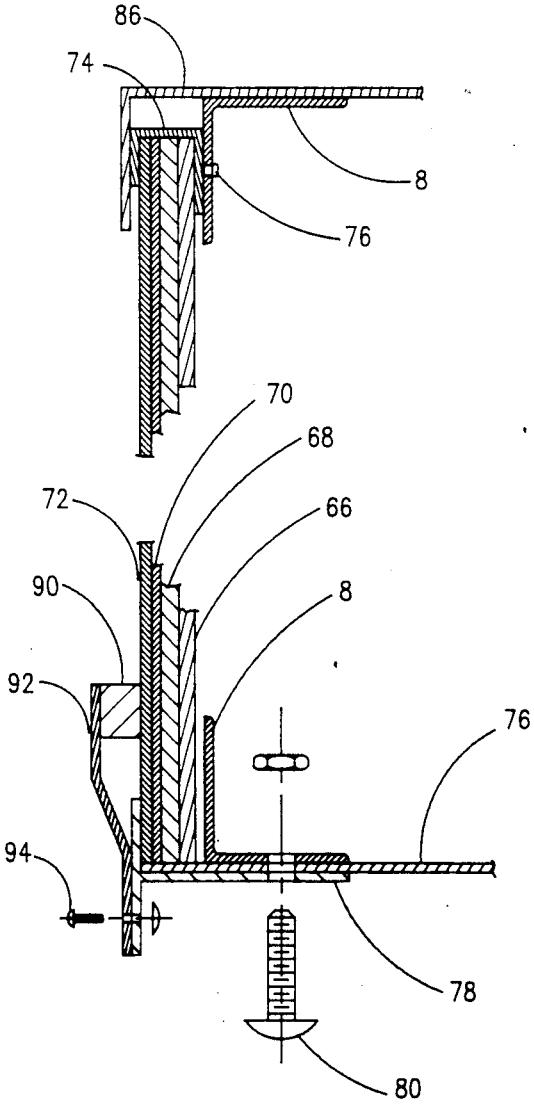
FIG. 7 a partial cross section view as viewed in the direction shown along plane 7—7 in FIG. 1, illustrating the sign face composite and arrangement.
Figure 8:
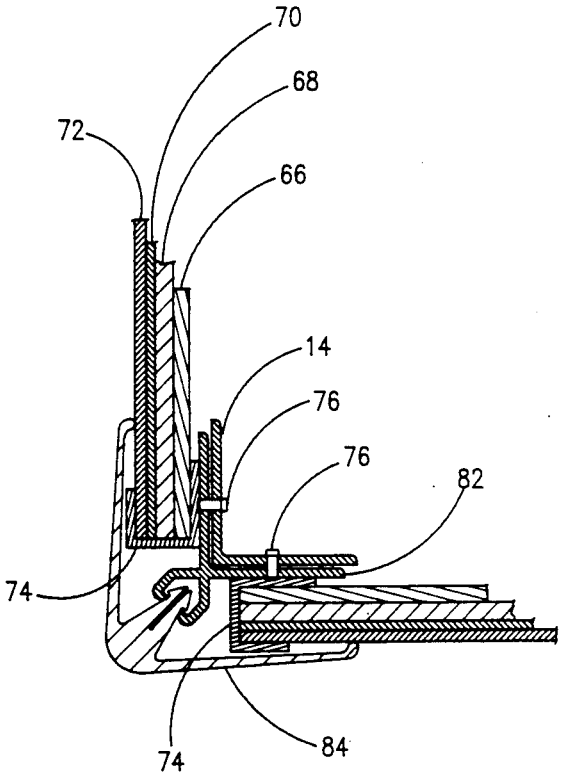
FIG. 8 is a partial typical corner cross section as viewed in the direction shown along plane 8—8 in FIG. 1, illustrating the sign face composite and corner molding attachments.

As can be seen most clearly in FIGS. 7 and 8 the face panels are a composite of laminated materials comprising a first inner panel 66 of 2–5 millimeters corrugated polyurethane orientated so that the ribbing runs horizontally, a second outer panel 68 of 2–5 millimeters corrugated polyurethane is orientated so that its ribbing runs vertically, the advertising picture paper 70 and finally a ⅛ inch clear plexiglass sheet 72. The laminated panels are held in position by channel clips 74 along the top and each side fasten to upper frame 8 and side structural angles 14 with rivets 76. The lower side of the laminated panels are retained by bottom cover 76 and clip 78 all of which are fastened to lower frame 8 with fasteners 80. Extruded corner moldings 84 are snapped into extruded corner clips 82 sandwiched between vertical angles 14 and channel clips 74.

The face panels are further protected from wind and moisture by the top rain cap 86 and pedestal seal cap 88 shown in FIG. 1 and FIG. 7. The lower edge of the face panel utilizes a spring seal arrangement consisting of a foam gasket 92 adheasely mounted to a spring plate which is riveted to clip 78.

Reduction of condensate accumulation between the plexiglass sheet 72 and the advertising picture paper 70 is reduced by drilling small holes spaced approximately two inches apart through panels 66 and 68.

Figure 10:
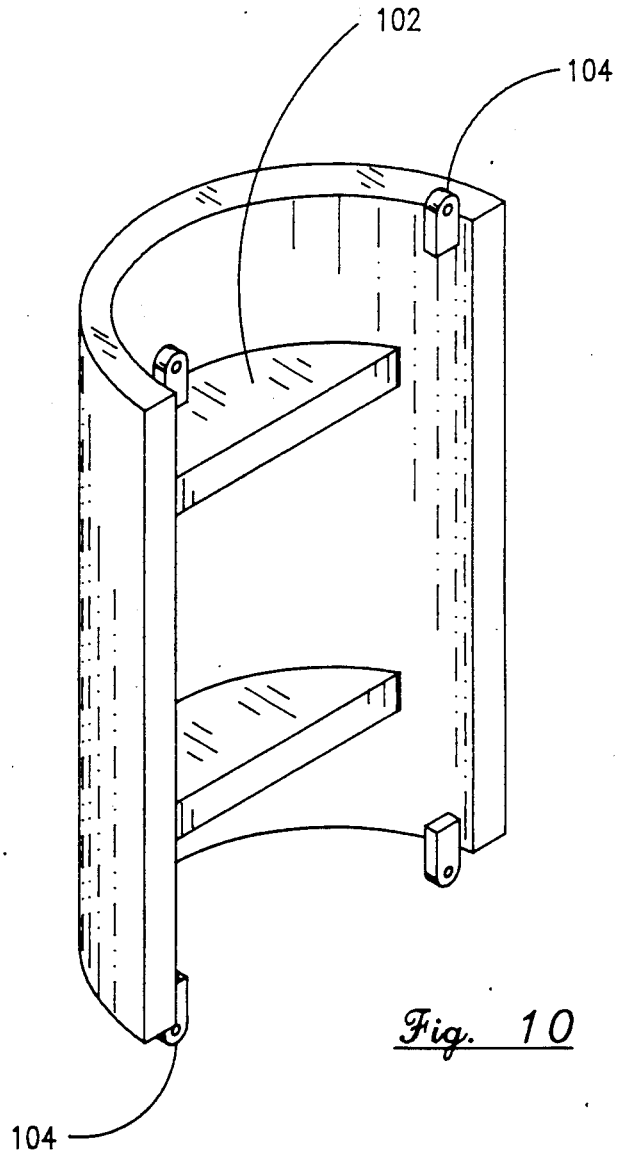
FIG. 10 is an isometric view of one half of the adapter illustrating the internal clamp webs and clamping ears.

Adaptation to non-round sign pedestal/support columns may be achieved by attaching a clamping collar 96 of the type shown in FIGS. 9 and 10 around a support 106 using spacers 98 as necessary to supplement clamp webs 102. The collar 96 is drawn back into its true circle shape by bolts 100. The collar(s) are located so that rotatable rollers 22 located on the upper and lower annulus flanges 10 will be in rolling contact with its outer surface.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A motor-driven revolving sign comprising a rigid, multi-sided structural frame, the structural frame mounted around an existing sign post and having an upper section, and defining a plurality of sign faces therearound, mounting means positioned at upper and lower portions of the structural frame, and supported between the structural frame in frictional contact with the sign post, a friction ring attached to the mounting means at the upper portion of the structural frame, a plurality of adjustable rotating stabilizing elements attached to the mounting means for maintaining the structural frame in concentric rotating alignment around the sign post, a motor secured to the mounting means, friction wheel drive means mounted to the motor and in rolling contact with the friction ring for rotating the structural frame when the motor is activated.

2. The apparatus of claim 1 wherein the structural frame has a removable quarter section permitting the structural frame to be emplaced about and to be removed from the sign post.

3. The apparatus of claim 1, wherein there is further included an adjustable support member for adjustably mounting the friction wheel drive means and motor to the mounting means.

4. The apparatus of claim 1 further comprising clamp means for attaching the mounting means to the sign post.

5. The apparatus of claim 1 wherein there is further included a cap attached to the upper section of the structural frame for sealing the frame.

6. The apparatus of claim 1, wherein the mounting means further includes upper and lower annular flanges structurally supported at each corner by diagonal struts attached to the structural frame.

7. The apparatus of claim 1 wherein there is further included at least two vertical support casters for supporting the structural frame, the casters attached to brackets secured to the mounting means, the casters in rolling contact with the upper annular flange of the structural frame and facilitating rotation of the structural frame.

8. A motor-driven revolving sign, comprising a rigid structural frame with a plurality of vertical sides, the structural frame having upper and lower sections structurally supported by and attached to the structural frame, with at least one removable quarter section to allow assembly around an existing sign pedestal, display means attached to each vertical side of the structural frame, the structural frame having upper and lower annular flanges structurally supported at each corner by diagonal struts attached to the structural frame, a friction ring attached to the upper annular flange's diagonal struts, a plurality of adjustable rotatable stabilizing elements attached to the upper and lower annular flanges to hold the annular flanges in concentric rotating alignment around the sign pedestal, mounting means positioned at upper and lower portions of the structural frame and supported between the structural frame in frictional contact with the sign post, a motor secured to the mounting means, friction wheel drive means mounted to the motor and in rolling contact with the friction ring for rotating the structural frame when the motor is activated, an adjustable support member for adjustably mounting the friction wheel drive means and motor to the mounting means, at least two vertical support casters for supporting the structural frame, the casters attached to brackets positioned perpendicular to, and in rolling contact with, the upper annular flange of the structural frame and facilitating rotation of the structural frame, clamp means for attaching the mounting means to the said sign pedestal, a first cap attached to the upper section of the structural frame for sealing said frame, a seal cap, attached to the first cap for sealing around the sign pedestal, and a lower cover for sealing the lower section of the structural frame.

9. The motor-driven revolving sign of claim 8 wherein the display means further comprise a picture paper for displaying advertising, a plurality of corrugated panels for supporting the picture paper, a plurality of channel clips attached to the structural frame for retaining the panels thereon, and a plexiglass sheet for covering the picture paper.

10. The motor-driven revolving sign of claim 8 wherein the adjustable rotating stabilizing elements include a pivot arm pivotally mounted at one end to the annular flange, a wheel rotatably mounted at an opposite end of the pivot arm, a threaded rod traversing the annular flange and pivotally engaging the pivot arm at a mid point of it with adjustment nuts located at sides of the annular flange.

11. The motor-driven revolving sign of claim 8 including a biasing means for maintaining engagement between the friction wheel and friction ring, a pivot plate pivotally mounted on the adjustable support member for mounting the motor, and a pivot means for mounting the pivot plate on the adjustable support member.

12. The motor-driven revolving sign of claim 8, wherein each of the display means further comprises at least two corrugated panels with corrugation ribbing rotated 90 degrees apart to provide maximum rigidity, and a snap-in plastic corner channel molding for sealing along sides of the display panels.

13. The motor-driven revolving sign of claim 8, wherein the friction wheel is a tire.

14. The motor-driven revolving sign of claim 8 wherein the brackets secured to the mounting means include at least two horizontal caster support plates with a plurality of caster mounting holes, the caster support plates held fixed and spaced apart by a rigid upper horizontal cross member, with at least two traverse holes for receiving a first thread rod clamping means, a lower horizontal cross member, with at least two traverse holes for receiving a second thread rod clamping means, held fixedly apart from said upper horizontal cross member by a vertical structural channel with flanges turned perpendicular to the upper and lower cross members, a vertical pivot mounting plate with a plurality of mounting holes extending perpendicular from an exterior web of the structural channel for mounting a pivotal bearing means and a motor pivot arm pivotally mounted and rotatable about the pivotal bearing means for mounting the motor.

15. The motor-driven revolving sign of claim 14, wherein the clamp means includes an upper and lower horizontal cross member held in a fixed spaced apart relationship by a structural channel with legs perpendicular to the cross members and with at least two all thread rods traversing each of the upper and lower horizontal cross members, with a lock nut and a jam nut at both ends of the all thread rods.

16. The motor-driven revolving sign of claim 8 wherein the structural frame further includes an extruded plastic corner clip mounted along elevated corners of the structural frame.

17. The motor-driven revolving sign of claim 16 wherein the extruded plastic corner clip is molded in the form of a structural L-shape, having two legs right angles to each other and a pair of jaws, with inwardly facing cleats, forming a channel along its spine.

18. The motor-driven revolving sing of claim 16 wherein the extruded plastic corner molding is molded in the form of a structural angle with legs at right angles to each other and with each leg having enlarged radiused tips at a distal end thereof, the corner molding also having a raised projection extending along an inside leg intersection, culminating in double flukes with a slit dividing the flukes.

19. The motor-driven revolving sign of claim 8, further comprising an adapter for use with the sign, the adapter for clamping around a pedestal or post for converting the pedestal from multi-faced to a round configuration at point of contact with a rotatable stabilizing element.

20. The motor-driven revolving sign of claim 19, wherein the adapter has spacers to accommodate a non-round sign pedestal.

* * * * *